US006587085B2

(12) United States Patent
Lee et al.

(10) Patent No.: US 6,587,085 B2
(45) Date of Patent: Jul. 1, 2003

(54) METHOD OF A DRIVING PLASMA DISPLAY PANEL

(75) Inventors: Joo-yul Lee, Chungcheongnam-do (KR); Jeong-duk Ryeom, Cheonan (KR); Kyoung-ho Kang, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 204 days.

(21) Appl. No.: 09/727,468

(22) Filed: Dec. 4, 2000

(65) Prior Publication Data

US 2001/0024180 A1 Sep. 27, 2001

(30) Foreign Application Priority Data

Dec. 10, 1999 (KR) ..... 99-56558

(51) Int. Cl.[7] ..... G09G 3/28

(52) U.S. Cl. ..... 345/60; 345/60; 345/66; 345/67; 315/169.4

(58) Field of Search ..... 345/60, 66, 67; 313/570, 583; 315/169.4, 169.2, 169.3, 169.1

(56) References Cited

U.S. PATENT DOCUMENTS 5,519,520 A * 5/1996 Stoller ..... 345/66
6,054,970 A * 4/2000 Hirakawa et al. ..... 345/60
6,262,699 B1 * 7/2001 Suzuki et al. ..... 345/60
6,353,287 B1 * 3/2002 Sasaki et al. ..... 313/570
6,356,017 B1 * 3/2002 Makino ..... 313/583

* cited by examiner

*Primary Examiner*—Steven Saras
*Assistant Examiner*—Uchendu O. Anyaso

(57) ABSTRACT

A method of driving a plasma display panel having front and rear substrates opposed to and facing each other, X and Y electrode lines formed between the front and rear substrates to be parallel to each other, address electrode lines formed to be orthogonal to the X and Y electrode lines, to define corresponding pixels at interconnections, and the address electrode lines are cut into two parts at the middle portions thereof to then form first and second panels separately driven such that the minimum driving period includes a display discharge period, a reset period and an address period, a scan pulse is applied to at least one of the respective Y electrode lines during the address period and the corresponding display data signals are simultaneously applied to the respective address electrode lines to form wall charges at pixels to be displayed, pulses for a display discharge are alternately applied to the X and Y electrode lines to cause a display discharge at the pixels where the wall charges have been formed, and a reset pulse for forming space charges while erasing the wall charges remaining from the previous subfield is applied to the corresponding Y electrode lines during the reset period, wherein the address period is applied to the second panel while the display discharge period and the reset period are applied to the first panel.

10 Claims, 5 Drawing Sheets

T11 T12 T21 T22 T31 T32 T41 T42 T51 T52 T61

SY1
GND

SY2
tA1

SY3
tA2

SY4
tA3

SY2n+1
tA4

SY2n+2
tA5

SY2n+3
tA6

SY2n+4
tA7

SX1..4
tA8

SX2n+1..4

SUA1..m

SLA1..m

METHOD OF A DRIVING PLASMA DISPLAY PANEL

CROSS-REFERENCE TO RELATED APPLICATIONS

This application claims the benefit of Korean Application No. 99-56558, filed Dec. 10, 1999, in the Korean Patent Office, the disclosure of which is incorporated herein by reference.

BACKGROUND OF THE INVENTION

1. Field of the Invention

The present invention relates to a method of driving a plasma display panel, and more particularly, to a method of driving a three-electrode surface-discharge plasma display panel.

2. Description of the Related Art

FIG. 1 shows a structure of a general three-electrode surface-discharge plasma display panel, FIG. 2 shows an electrode line pattern of the panel shown in FIG. 1, and FIG. 3 shows an example of a pixel of the panel shown in FIG. 1. Referring to the drawings, address electrode lines $A_1$, $A_2$, . . . $A_m$, dielectric layers 11 and 15, Y electrode lines $Y_1$, . $Y_2$, . . . $Y_n$, X electrode lines $X_1$, $X_2$, . . . $X_n$, phosphors 16, partition walls 17 and an MgO protective film 12 are provided between front and rear glass substrates 10 and 13 of a general surface-discharge plasma display panel 1.

The address electrode lines $A_1$, $A_2$, . . . $A_m$ are provided over the front surface of the rear glass substrate 13 in a predetermined pattern. The lower dielectric layer 15 covers the entire front surface of the address electrode lines $A_1$, $A_2$, . . . $A_m$. The partition walls 17 are formed on the front surface of the lower dielectric layer 15 to be parallel to the address electrode lines $A_1$, $A_2$, . . . $A_m$. The partition walls 17 define discharge areas of the respective pixels and prevent optical crosstalk among pixels. The phosphors 16 are coated between partition walls 17.

The X electrode lines $X_1$, $X_2$, . . . $X_n$ and the Y electrode lines $Y_1$, $Y_2$, . . . $Y_n$ are arranged on the rear surface of the front glass substrate 10 so as to be orthogonal to the address electrode lines $A_1$, $A_2$, . . . $A_m$, in a predetermined pattern. The respective intersections define corresponding pixels. Each of the X electrode lines $X_1$, $X_2$, . . . $X_n$ and the Y electrode lines $Y_1$, . $Y_2$ . . . $Y_n$ comprises a transparent, conductive indium tin oxide (ITO) electrode line ($X_{na}$ or $Y_{na}$ of FIG. 3) and a metal bus electrode line ($X_{nb}$ or $Y_{nb}$ of FIG. 3). The upper dielectric layer 11 is entirely coated over the rear surfaces of the X electrode lines $X_1$, $X_2$, . . . $X_n$ and the Y electrode lines $Y_1$, . $Y_2$, . . . $Y_n$. The MgO protective film 12 for protecting the plasma display panel 1 against strong electrical fields is entirely coated over the rear surface of the upper dielectric layer 11. A gas for forming plasma is hermetically sealed in a discharge space 14.

The above-described plasma display panel 1 is basically driven such that a reset step, an address step and a sustain-discharge step are sequentially performed in a unit subfield. In the reset step, wall charges remaining from the previous subfield are erased and space charges are evenly formed. In the address step, the wall charges are formed in a selected pixel area. Also, in the sustain-discharge step, light is produced at the pixel at which the wall charges are formed in the address step. In other words, if alternating pulses of a relatively high voltage are applied between the X electrode lines $X_1$, $X_2$, . . . $X_n$ and the corresponding Y electrode lines $Y_1$, $Y_2$, . . . $Y_n$, a surface discharge occurs at the pixels at which the wall charges are formed. Here, plasma is formed at the gas layer of the discharge space 14 and phosphors 16 are excited by ultraviolet rays to thus emit light.

FIG. 4 shows the structure of a unit display period based on a driving method of a general plasma display panel. Here, a unit display period represents a frame in the case of a progressive scanning method, and a field in the case of an interlaced scanning method. The driving method shown in FIG. 4 is generally referred to as a multiple address overlapping display driving method. According to this driving method, pulses for a display discharge are consistently applied to all X electrode lines ($X_1$, $X_2$, . . . $X_n$ of FIG. 1) and all Y electrode lines ($Y_1$, $Y_2$, . . . $Y_{480}$) and pulses for resetting or addressing are applied between the respective pulses for a display discharge. In other words, the reset and address steps are sequentially performed with respect to individual Y electrode lines or groups, within a unit subfield, and then the display discharge step is performed for the remaining time period. Thus, compared to an address-display separation driving method, the multiple address overlapping display driving method has an enhanced displayed luminance. Here, the address-display separation driving method refers to a method in which within a unit subfield, reset and address steps are performed for all Y electrode lines $Y_1$, $Y_2$, . . . $Y_{480}$, during a certain period and a display discharge step is then performed.

Referring to FIG. 4, a unit frame is divided into 8 subfields $SF_1$, $SF_2$, . . . $SF_8$ for achieving a time-divisional gray scale display. In each subfield, reset, address and display discharge steps are performed, and the time allocated to each subfield is determined by a display discharge time. For example, in the case of displaying 256 scales by 8-bit video data in the unit of frames, if a unit frame (generally 1/60 second) comprises 256 unit times, the first subfield $SF_1$, driven by the least significant bit (LSB) video data, has 1 ($2^0$) unit time, the second subfield $SF_2$ 2 ($2^1$) unit times, the third subfield $SF_3$ 4 ($2^2$) unit times, the fourth subfield $SF_4$ 8 ($2^3$) unit times, the fifth subfield $SF_5$ 16 ($2^4$) unit times, the sixth subfield $SF_6$ 32 ($2^5$) unit times, the seventh subfield $SF_7$ 64 ($2^6$) unit times, and the eighth subfield $SF_8$, driven by the most significant bit (MSB) video data, 128 ($2^6$) unit times. In other words, since the sum of unit times allocated to the respective subfields is 257 unit times, 255 scales can be displayed, 256 scales including one scale which is not display-discharged at any subfield.

In the driving method of the multiple address overlapping display, a plurality of subfields $SF_1$, $SF_2$, . . . $SF_8$ are alternately allocated in a unit frame. Thus, the time for a unit subfield equals the time for a unit frame. Also, the elapsed time of all unit subfields $SF_1$, $SF_2$, . . . $SF_8$ is equal to the time for a unit frame. The respective subfields overlap on the basis of the driven Y electrode lines $Y_1$, $Y_2$, . . . $Y_{480}$, to form a unit frame. Thus, since all subfields $SF_1$, $SF_2$, . . . $SF_8$ exist in every timing, time slots for addressing depending on the number of subfields are set between pulses for display discharging, for the purpose of performing the respective address steps.

FIG. 5 shows an electrode line pattern of the general plasma display panel 1 driven based on the address-display separation driving method. Referring to FIG. 5, in the general plasma display panel based on the address-display separation driving method, each of the address electrode lines $A_1$, $A_2$, . . . $A_m$ is cut in a middle portion to form an upper panel and a lower panel. A first Y electrode line $Y_1$ to an $$\frac{n}{2}$$

th Y electrode line $$Y_{\frac{n}{2}}$$

and a first X electrode line $X_1$ to an $$\frac{n}{2}$$

th X electrode line $$X_{\frac{n}{2}}$$

are allocated to the upper panel. An $$\left(\frac{n}{2}+1\right)$$

th Y electrode line to an nth Y electrode line $Y_1$ and a $$\left(\frac{n}{2}+1\right)$$

th X electrode line $$X_{\frac{n}{2}+1}$$

to an nth X electrode line $X_n$ are allocated to the lower panel. As described above, since the plasma display panel 1 is separated into two parts to then be simultaneously driven, an addressing time is reduced to a half.

In order to drive the separately driven plasma display panel shown in FIG. 5 by the address-display overlapping driving method shown in FIG. 4, a driving method in which the minimum driving period consisting of a minimum display discharge period, a minimum reset period, and a minimum address period is consistently repeated, is generally used. According to this driving method, the pulses for display discharges are alternately applied to all Y and X electrode lines during the minimum display discharge period, and the minimum reset and address periods are applied between the minimum display discharge periods. In other words, the minimum reset and address periods are applied during the quiescent period of a sustained discharge. Here, during the minimum address period, the scan pulses are applied to at least one Y electrode line in the order of the respective subfields $SF_1$, $SF_2$, . . . $SF_8$, and the corresponding display data signals are applied to the respective address electrode lines.

When the above-described driving method is adopted to the separately driven plasma display panel, the phase of the minimum driving period of the upper panel has been conventionally equal to that of the lower panel. Accordingly, since the upper and lower panels have the driving period of the same mode at the time, the overall maximum instantaneous power becomes increased. For example, if all display cells of the upper and lower panel emit light during the minimum display discharge period, the overall instantaneous power is considerably increased. Due to the considerable increase in the maximum instantaneous power, the burden in the capacity of a power supply circuit and the effects of noise and electromagnetic interference are also increased.

SUMMARY OF THE INVENTION

To solve the above problem, it is an object of the present invention to provide a method of driving a plasma display panel which can reduce the burden on the capacity of a power supply circuit and the effects of noise and electromagnetic interference.

Additional objects and advantages of the invention will be set forth in part in the description which follows and, in part, will be obvious from the description, or may be learned by practice of the invention.

To achieve the above and other objects of the invention, there is provided a method of driving a plasma display panel having address lines cut into two parts to form first and second panels which are separately driven, the method comprising generating driving periods of different modes at any given time for the first and second panels.

To achieve the above and other objects of the invention, there is also provided a method of driving a plasma display panel having address lines cut into two parts to form first and second panels which are separately driven, the method comprising temporally alternating minimum display discharge periods for each of the first and second panels.

To achieve the above and other objects of the invention, there is still also provided a method of driving a plasma display panel having front and rear substrates opposed to and facing each other, X and Y electrode lines formed between the front and rear substrates to be parallel to each other, address electrode lines formed to be orthogonal to the X and Y electrode lines, to define corresponding pixels at interconnections, and the address electrode lines are cut into two parts at the middle portions thereof to then form first and second panels separately driven such that the minimum driving period includes a display discharge period, a reset period and an address period, a scan pulse is applied to at least one of the respective Y electrode lines during the address period and the corresponding display data signals are simultaneously applied to the respective address electrode lines to form wall charges at pixels to be displayed, pulses for a display discharge are alternately applied to the X and Y electrode lines to cause a display discharge at the pixels where the wall charges have been formed, and a reset pulse for forming space charges while erasing the wall charges remaining from the previous subfield is applied to the corresponding Y electrode lines during the reset period, wherein the address period is applied to the second panel while the display discharge period and the reset period is applied to the first panel.

Accordingly, since the upper panel and the lower panel have driving periods of different modes all the time, the maximum instantaneous power is relatively decreased. For example, for all display cells of the upper and lower panels, the minium display discharge periods alternate temporally. Thus, the overall instantaneous power is relatively decreased. Therefore, the burden in the capacity of a power supply circuit and the effects of noise and electromagnetic interference can be reduced.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

Figures 6A, 6B, 6C, 6D, 6E, 6F, 6G, 6H, 6I, 6J, 6K, 6L:
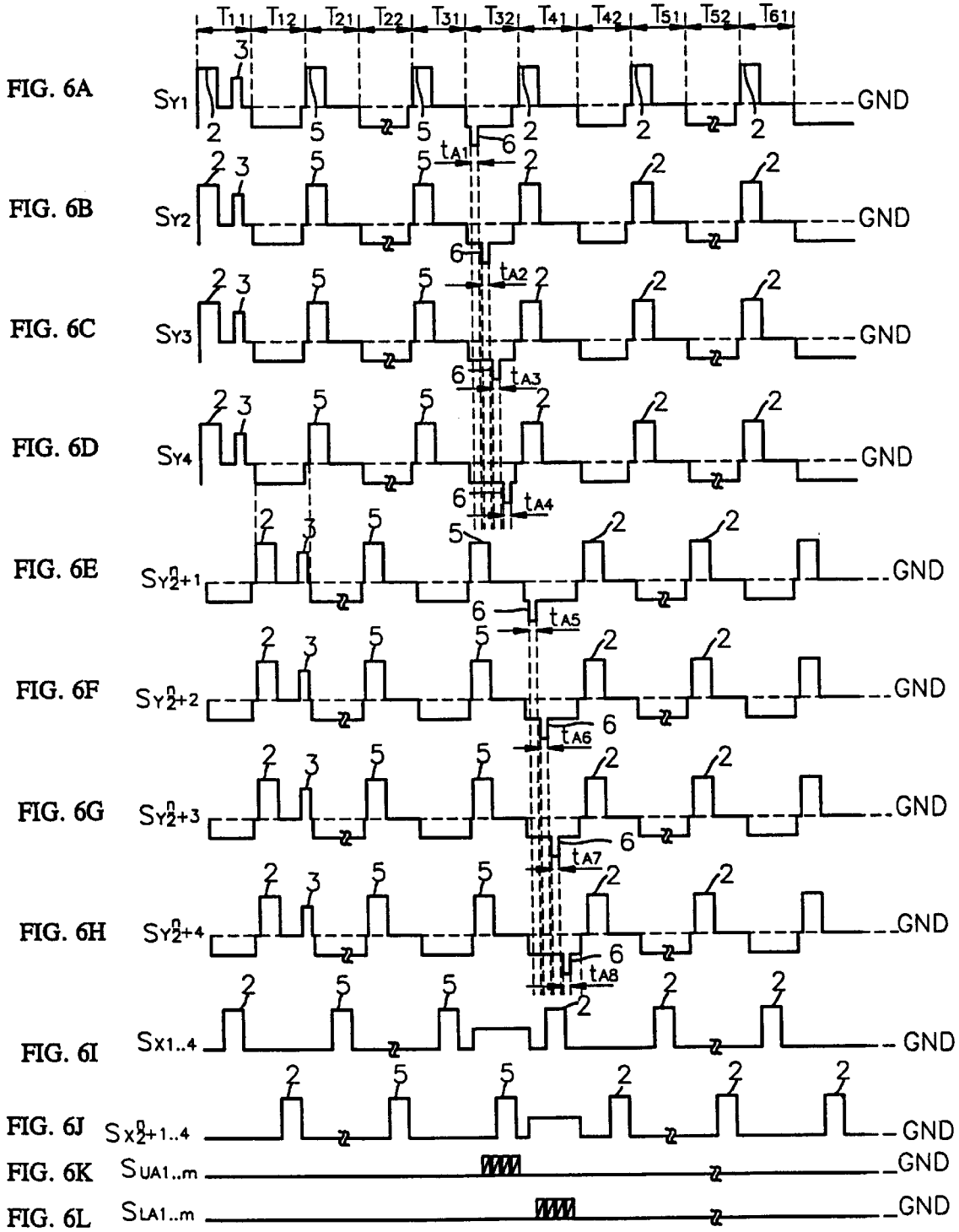
FIG. 6 is a voltage waveform diagram of driving signals in a unit display period based on a method of driving a plasma display panel according to the present invention.

FIGS. 6A through 6C show driving signals in a unit subfield based on a driving method according to an embodiment of the present invention. In FIGS. 6A through 6C, reference marks $S_{Y1}$, $S_{Y2}$, . . . $S_{Y4}$ (FIGS. 6A through 6D) denote upper Y electrode driving signals applied to upper Y electrode lines corresponding to first through fourth subfields $SF_1$, $SF_2$, . . . $SF_4$ of FIG. 4, and $$S_{Y\frac{n}{2}+1}, S_{Y\frac{n}{2}+2}, \ldots S_{Y\frac{n}{2}+4}$$

(FIGS. 6E through 6H) denote lower Y electrode driving signals applied to the respective lower Y electrode lines. In more detail, $S_{Y1}$ denotes a driving signal applied to an upper Y electrode line of the first subfield $SF_1$, $S_{Y2}$ denotes a driving signal applied to an upper Y electrode line of the second subfield $SF_2$, $S_{Y3}$ denotes a driving signal applied to an upper Y electrode line of the third subfield $SF_3$, $S_{Y4}$ denotes a driving signal applied to an upper Y electrode line of the fourth subfield $SF_4$, $$S_{Y\frac{n}{2}+1}$$

denotes a driving signal applied to a lower Y electrode line of the first subfield $SF_1$, $$S_{Y\frac{n}{2}+2}$$

denotes a driving signal applied to a lower Y electrode line of the second subfield $SF_2$, $$S_{Y\frac{n}{2}+3}$$

denotes a driving signal applied to a lower Y electrode line of the third subfield $SF_3$, and $$S_{Y\frac{n}{2}+4}$$

denotes a driving signal applied to a lower Y electrode lines of the fourth subfield $SF_4$, respectively. Reference mark $S_{X1.4}$ (FIG. 6I) denotes driving signals applied to upper X electrode line groups corresponding to scanned upper Y electrode lines, and $$S_{X\frac{n}{2}+1\ldots4}$$

(FIG. 6J) denotes driving signals applied to the lower X electrode line groups corresponding to scanned lower Y electrode lines, $S_{UA1.m}$ (FIG. 6K) denotes upper display data signals corresponding to scanned upper Y electrode lines, $S_{LA1.m}$ (FIG. 6L) denotes lower display data signals corresponding to scanned upper Y electrode lines, and GND denotes a ground voltage.

Figure 1:
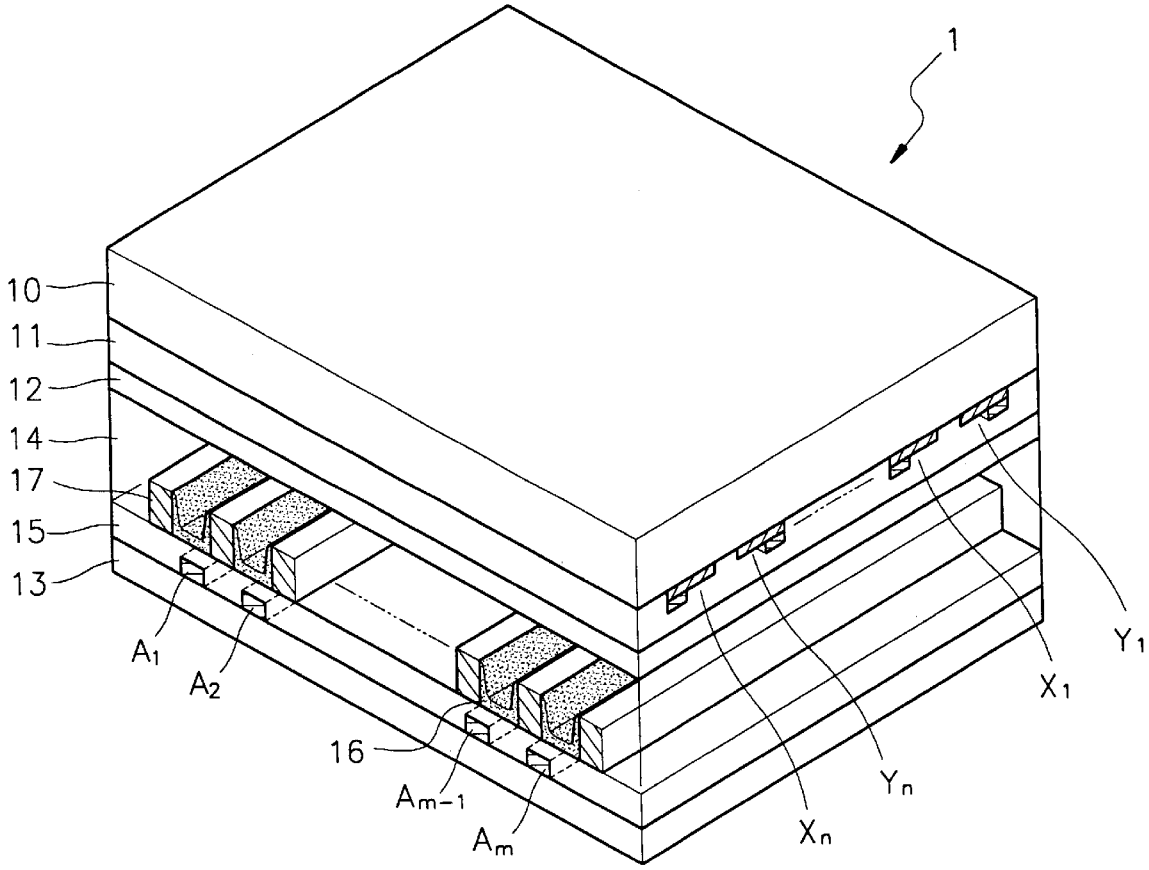
FIG. 1 PRIOR ART
FIG. 1 shows an internal perspective view illustrating the structure of a general three-electrode surface-discharge plasma display panel.
Figure 2:
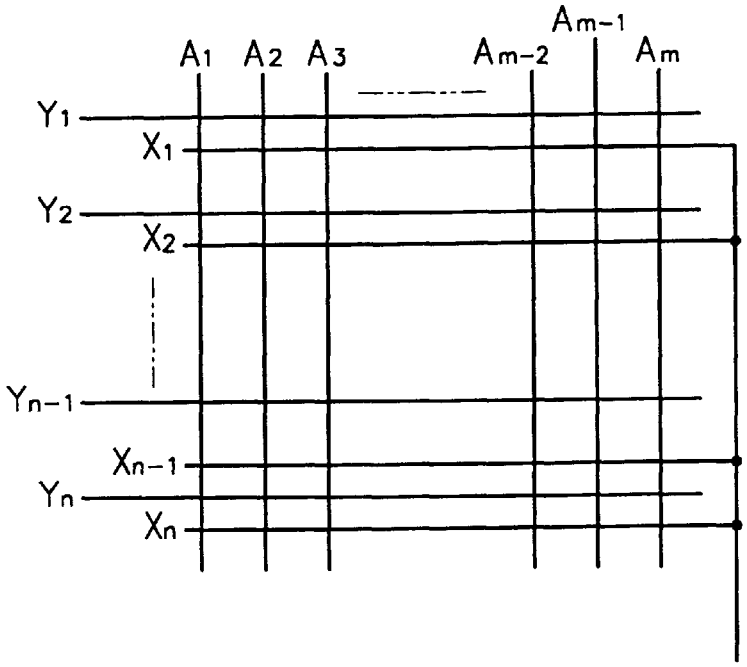
PRIOR ART FIG. 2
FIG. 2 shows an electrode line pattern of the plasma display panel shown in FIG. 1.
Figure 3:
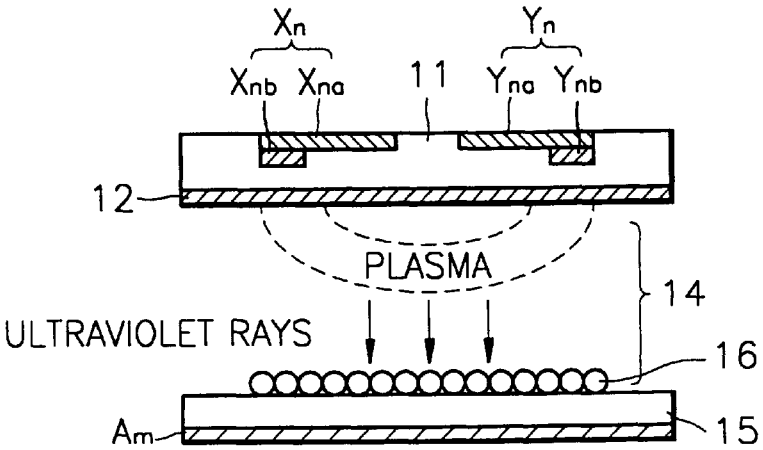
PRIOR ART FIG. 3
FIG. 3 is a cross section of an example of a pixel of the plasma display panel shown in FIG. 1.
Figure 4:
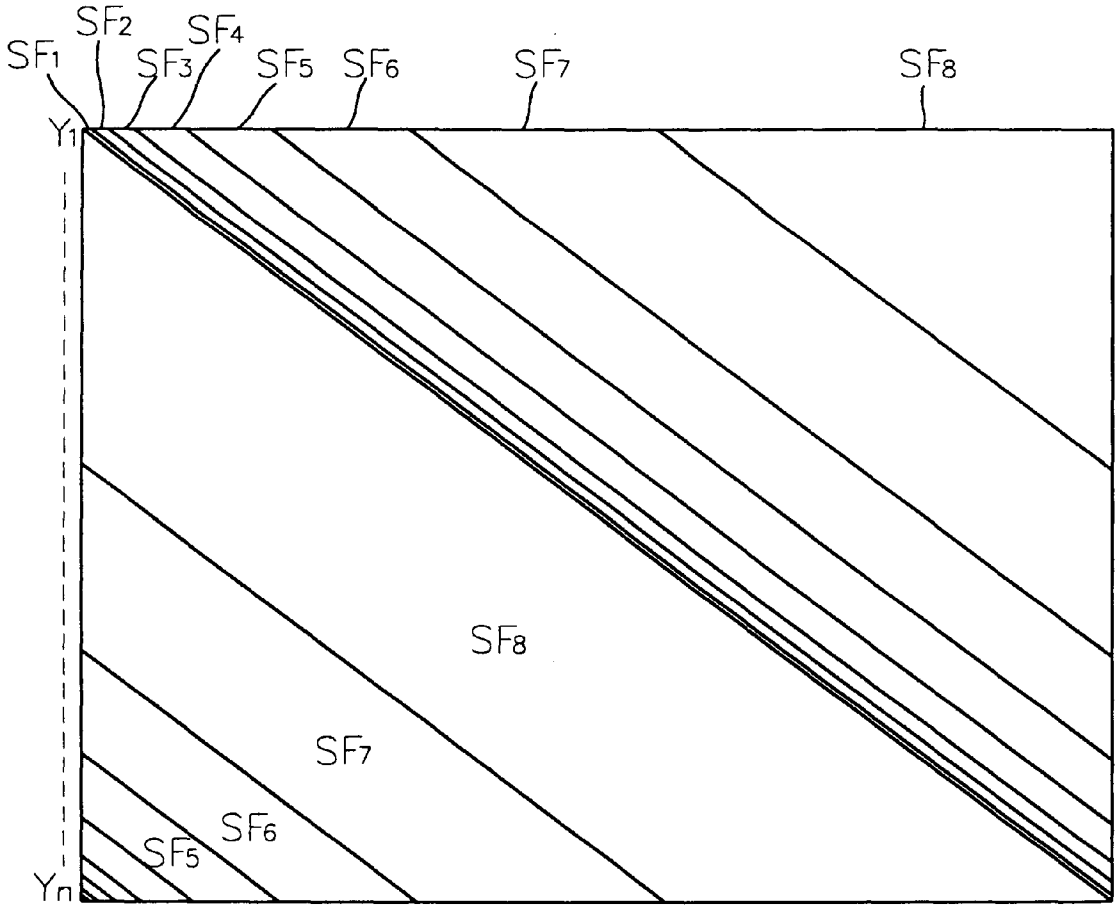
FIG. 4 PRIOR ART
FIG. 4 is a timing diagram showing the format of a unit display period based on a general method for driving the plasma display panel shown in FIG. 1.
Figure 5:
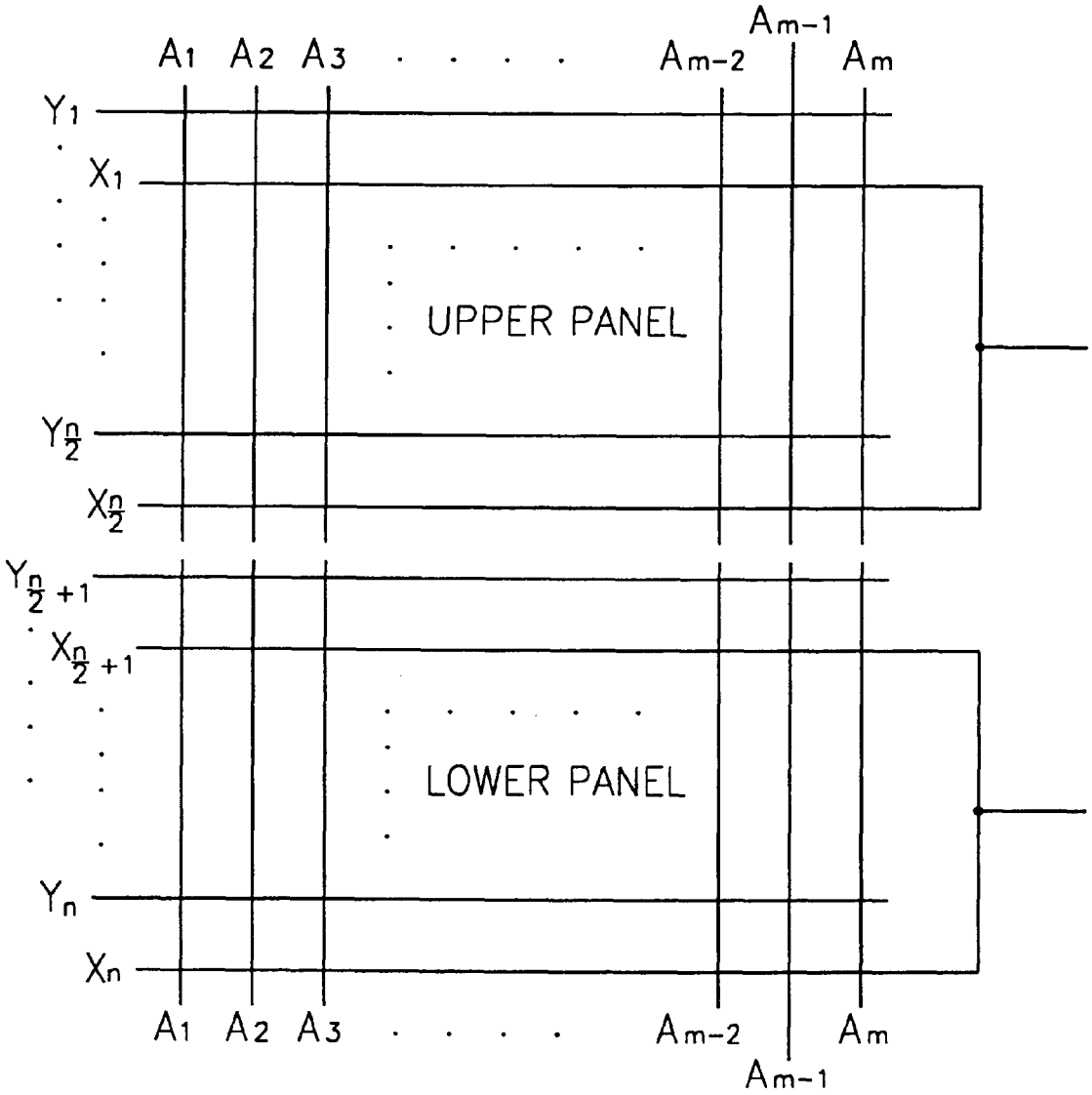
PRIOR ART FIG. 5
FIG. 5 is a diagram showing an electrode line pattern of a general plasma display panel based on an address-display separation driving method.

Although only four subfields are illustrated in FIGS. 6A through 6L for brevity, the same driving method can also be applied to 8 subfields. For example, the addressing period for the upper Y electrode lines corresponding to the fifth through eighth subfields $SF_5$, $SF_6$, . . . $SF_8$of FIG. 4 is $T_{42}$, and the addressing period for the lower Y electrode lines is $T_{51}$.

Referring to FIGS. 6A through 6L, while the minimum display discharge periods and the minimum reset periods $T_{11}$, $T_{21}$, $T_{31}$, $T_{41}$, $T_{51}$, and $T_{61}$, are applied to the upper panel, the minimum address periods are applied to the lower panel. Then, while the minimum address periods $T_{12}$, $T_{22}$, $T_{32}$, $T_{42}$, $T_{52}$ and $T_{62}$, are applied to the upper panel, the minimum display discharge periods and the minimum reset periods are applied to the lower panel. As described above, the upper panel and the lower panel have driving periods of different modes all the time, and as a result, the overall maximum instantaneous power is relatively reduced. For example, if all the display cells of the upper and lower panels emit light, since the minimum display discharge periods alternate temporally, the overall instantaneous power is relatively lowered. Accordingly, the burden in the capacity of a power supply circuit and the effects of noise and electromagnetic interference can be reduced.

During the respective display discharge periods, display discharges occur at pixels where wall charges have been formed, by alternately applying pulses 2 and 5 for display discharges to the X and Y electrode lines $X_1$, $X_2$, . . . $X_n$ and $Y_1$, $Y_2$, . . . $Y_{480}$. During the respective minimum reset periods, reset pulses 3 are applied to the Y electrode lines to be scanned during subsequent address periods for forming space charges while erasing the wall charges remaining from the previous subfield. During the minimum address periods, while scan pulses 6 are sequentially applied to the Y electrode lines corresponding to four subfields, the corresponding display data signals are applied to the respective address electrode lines, thereby forming wall charges at pixels to be displayed.

Predetermined quiescent periods exist after application of the pulses 3 and before application of the scan pulses 6, to make space charges be distributed smoothly at the corresponding pixel areas. In FIG. 6, $T_{12}$, $T_{21}$, $T_{22}$ and $T_{31}$ are quiescent periods for the upper Y electrode lines of the first through fourth subfields $SF_1$ through $SF_4$, and $T_{21}$, $T_{22}$, $T_{31}$ and $T_{32}$ are quiescent periods for the lower Y electrode lines of the first through fourth subfields $SF_1$ through $SF_4$. Although the pulses 5 for display discharges applied during the respective quiescent periods cannot actually cause a display discharge, they allow space charges to be distributed smoothly at the corresponding pixel areas. However, the pulses 2 for display discharges applied during non-quiescent periods cause display discharges to occur at the pixels where the wall charges have been formed by the scan pulses 6 and the display data signals $S_{UA1.m}$ or $S_{LA1.m}$.

During the minimum address period $T_{32}$ or $T_{41}$ between the final pulses among the pulses 5 for display discharge applied during the quiescent periods and the first subsequent pulses 2, addressing is performed four times. For example, during the period $T_{32}$, addressing is performed for the corresponding upper Y electrode lines of the first through fourth subfields $SF_1$ through $SF_4$. Also, during the period $T_{41}$, addressing is performed for the corresponding lower Y electrode lines of the first through fourth subfields $SF_1$ through $SF_4$. As described above with reference to FIG. 4, since all subfields $SF_1$, $SF_2$, . . . $SF_8$ exist at every timing, time slots for addressing, depending on the number of subfields are set during the minimum address periods for the purpose of performing the respective address steps.

After the pulses 2 and 5 for display discharges simultaneously applied to the Y electrode lines $Y_1$, $Y_2$, . . . $Y_n$ terminate, the pulses 2 and 5 for display discharges simultaneously applied to the corresponding electrode lines $X_1$, $X_2$, . . . $X_n$ start to occur. Scan pulses 6 and the corresponding display data signals $S_{UA1 \ldots m}$ or $S_{LA1 \ldots m}$ are applied during the minimum address period before the pulses 2 and 5 for display discharges simultaneously applied to the Y electrode lines $Y_1$, $Y_2$, . . . $Y_n$ of the next minimum display discharge period start to occur after the pulses 2 and 5 for display discharges simultaneously applied to the electrode lines $X_1$, $X_2$, . . . $X_n$ terminate.

As described above, since the upper panel and the lower panel have driving periods of different modes all the time, the maximum instantaneous power is relatively decreased. For example, for all display cells of the upper and lower panels, the minium display discharge periods alternate temporally. Thus, the overall instantaneous power is relatively decreased. Therefore, the burden in the capacity of a power supply circuit and the effects of noise and electromagnetic interference can be reduced.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of driving a plasma display panel having address lines cut into two parts to form first and second panels which are separately driven, the method comprising:

generating driving periods of different modes at any given time for the first and second panels, by applying a minimum display discharge period and a minimum reset period to the first panel while applying a minimum address period to the second panel.

2. A method of driving a plasma display panel having front and rear substrates opposed to and facing each other, X and Y electrode lines formed between the front and rear substrates to be parallel to each other, address electrode lines formed to be orthogonal to the X and Y electrode lines, to define corresponding pixels at interconnections, and the address electrode lines are cut into two parts at the middle portions thereof to then form first and second panels separately driven such that the minimum driving period includes a display discharge period, a reset period and an address period, a scan pulse is applied to at least one of the respective Y electrode lines during the address period and corresponding display data signals are simultaneously applied to the respective address electrode lines to form wall charges at pixels to be displayed, pulses for a display discharge are alternately applied to the X and Y electrode lines to cause a display discharge at the pixels where the wall charges have been formed, and a reset pulse for forming space charges while erasing the wall charges remaining from a previous subfield is applied to the corresponding Y electrode lines during the reset period, wherein the driving method comprises:

applying the address period to the second panel while applying the display discharge period and the reset period to the first panel.

3. The method of claim 1, wherein the generating driving periods of different modes at any given time for the first and second panels further comprises:

applying display and reset pulses to first electrodes in the first panel during the minimum display discharge period and the minimum reset period of the first panel, applying a scan pulse to second electrodes in the second panel during the minimum address period of the second panel, and the minimum display discharge period and the minimum reset period of the first panel occur during the minimum address period of the second panel.

4. The method of claim 3, wherein the display and reset pulses are applied to the first electrodes while the scan pulse is applied to the second electrodes.

5. The method of claim 3, further comprising:

applying display and reset pulses to the second electrodes in the second panel during a minimum display discharge period and a minimum reset period of the second panel, applying a scan pulse to the first electrodes in the first panel during a minimum address period of the first panel, and the minimum display discharge period and the minimum reset period of the second panel occur during the minimum address period of the first panel.

6. The method of claim 5, wherein:

a first subfield includes the minimum display discharge period and the minimum reset period of the first panel which occur during the minimum address period of the second panel, a second subfield includes the minimum display discharge period and the minimum reset period of the second panel which occur during the minimum address period of the first panel, and a unit display period includes the first and second subfields.

7. The method of claim 2, wherein the applying the address period to the second panel while applying the display discharge period and the reset period to the first panel comprises:

applying the display and reset pulses to the X and/or Y electrode lines in the first panel during the display discharge period and the reset period of the first panel, applying the scan pulse to the Y electrode lines in the second panel during the address period of the second panel, and the display discharge period and the reset period of the first panel occur during the address period of the second panel.

8. The method of claim 7, wherein the display and reset pulses are applied to the X and Y electrode lines of the first panel while the scan pulse is applied to the Y electrode lines of the second panel.

9. The method of claim 7, further comprising:

applying the display and the reset pulses to the X and/or Y electrode lines in the second panel during the display discharge period and the reset period of the second panel, applying the scan pulse to the Y electrode lines in the first panel during the address period of the first panel, and the display discharge period and the reset period of the second panel occur during the address period of the first panel.

10. The method of claim 9, wherein:

a first subfield includes the display discharge period and the reset period of the first panel which occur during the address period of the second panel, a second subfield includes the display discharge period and the reset period of the second panel which occur during the address period of the first panel, and a unit display period includes the first and second subfields.

* * * * *